US009268290B2

(12) United States Patent
Yamamizu

(10) Patent No.: US 9,268,290 B2
(45) Date of Patent: Feb. 23, 2016

(54) IMAGE FORMING APPARATUS, IMAGE FORMING APPARATUS CONTROL METHOD, AND STORAGE MEDIUM

(71) Applicant: CANON KABUSHIKI KAISHA, Tokyo (JP)

(72) Inventor: Hiroshi Yamamizu, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/553,691

(22) Filed: Nov. 25, 2014

(65) Prior Publication Data

US 2015/0153702 A1 Jun. 4, 2015

(30) Foreign Application Priority Data

Nov. 29, 2013 (JP) ..... 2013-247118

(51) Int. Cl.
*G03G 15/00* (2006.01)

(52) U.S. Cl.
CPC ..... *G03G 15/80* (2013.01); *G03G 15/5004* (2013.01)

(58) Field of Classification Search
CPC ... G03G 15/80; G03G 15/5004; G06F 1/3284
USPC ..... 399/88, 37
See application file for complete search history.

(56) References Cited

U.S. PATENT DOCUMENTS

2010/0325462 A1* 12/2010 Okuzono et al. ..... 713/324
2013/0061080 A1* 3/2013 Shimizu ..... 713/323
2013/0308148 A1* 11/2013 Hara ..... 358/1.13

FOREIGN PATENT DOCUMENTS

JP 2008-142942 A 6/2008

* cited by examiner

*Primary Examiner* — Sophia S Chen
(74) *Attorney, Agent, or Firm* — Canon USA, Inc. IP Division

(57) ABSTRACT

An apparatus configured to operate in a first power state and in a second power state that consumes less power than the first power state. In a case where a predetermined condition is satisfied, when a power-supply-off drive for switching a switch to an off side using a drive unit is executed and if it is detected that a power supply to the apparatus is not cut after executing of the power-supply-off drive, a control unit shifts a power state of the apparatus from the first power state to the second power state.

20 Claims, 9 Drawing Sheets

FIG.6

| POWER SAVING STATE | RETURN FACTOR | | | | |
|---|---|---|---|---|---|
| | POWER SAVING SWITCH DEPRESSION | NEW JOB RECEPTION | FAX TRANSMISSION | POWER SWITCH TURNED OFF | POWER SWITCH TURNED ON |
| HIGH SPEED START STATE | × | × | × | × | ○ |
| SLEEP STATE | ○ | ○ | ○ | ○ | × |
| POWER SAVING STATE AT POWER SWITCH ABNORMALITY OCCURRENCE | × | × | × | ○ | × |

○ : SET AS RETURN FACTOR

× : NOT SET AS RETURN FACTOR

FIG.7

POWER SWITCH COULD NOT BE TURNED OFF.
PLEASE TURN OFF POWER SWITCH ON RIGHT
SIDE OF MACHINE.

FIG.8

| | |
|---|---|
| SENDER | aaa@canon.co.jp |
| DATE AND TIME | MM DD, YYYY HH:MM:SS |
| DESTINATION | bbb@canon.co.jp |
| SUBJECT | REMOTE SHUTDOWN FAILURE |
| BODY | POWER SWITCH COULD NOT BE TURNED OFF.<br>PLEASE TURN OFF POWER SWITCH ON RIGHT SIDE OF MACHINE. |

IMAGE FORMING APPARATUS, IMAGE FORMING APPARATUS CONTROL METHOD, AND STORAGE MEDIUM

BACKGROUND OF THE INVENTION

1. Field of the Invention

The present invention relates to an image forming apparatus for performing power saving control, an image forming apparatus control method, and a storage medium.

2. Description of the Related Art

Conventionally, to reduce the power consumption of an apparatus, there has been an image forming apparatus, such as a copying machine or a printer, that includes an automatic-off drive circuit which automatically turns off a power switch if the apparatus has not been operated for a predetermined period of time. Japanese Patent Application Laid-Open No. 2008-142942 discusses an image forming apparatus that includes a mechanical relay in a power switch. When in a state in which the power switch is turned on, the image forming apparatus executes an automatic power-supply-off function that turns off the power switch when the mechanical relay is driven by external signal control.

In this case, in the image forming apparatus, if for some reason the mechanical relay drive fails, the power supply of the image forming apparatus is not turned off even if the automatic power-supply-off function is executed.

As an example of a case in which an administrator of the image forming apparatus tries to shut down each device all at once from an external environment, one such example may be when the power to a building where the image forming apparatus is located is stopped for building maintenance after shutdown has been executed.

If remote shutdown cannot be performed due to a power switch failure, and a power outage occurs while the image forming apparatus is still operating, shutdown processing cannot be executed normally because the power supply is suddenly turned off, which can becomes a factor of failure in the various devices in the image forming apparatus, such as a hard disk drive (HDD).

SUMMARY OF THE INVENTION

According to an aspect of the present invention, an apparatus configured to operate in a first power state and in a second power state that consumes less power than the first power state, includes a control unit configured to control a power supply to each unit, a switch configured to switch between supplying and cutting the power supply, a drive unit configured to drive the switch to an off side, an execution unit configured to execute a power-supply-off drive for switching the switch to the off side, if a predetermined condition is satisfied, and a detection unit configured to detect that the power supply to the apparatus is not cut after the power-supply-off drive has been executed, wherein in a case where the detection unit detects that the power supply to the apparatus is not cut, the control unit shifts a power state of the apparatus from the first power state to the second power state.

Further features of the present invention will become apparent from the following description of exemplary embodiments with reference to the attached drawings.

BRIEF DESCRIPTION OF THE DRAWINGS

FIG. 6 illustrates return factors of a power supply control unit in an image forming apparatus that is in a power saving state.

FIG. 7 illustrates a message screen displayed on an operation unit.

FIG. 8 illustrates contents of a notification E-mail.

DESCRIPTION OF THE EMBODIMENTS

Various exemplary embodiments, features, and aspects of the invention will be described in detail below with reference to the drawings.

<Description of the System Configuration>

Figure 1:
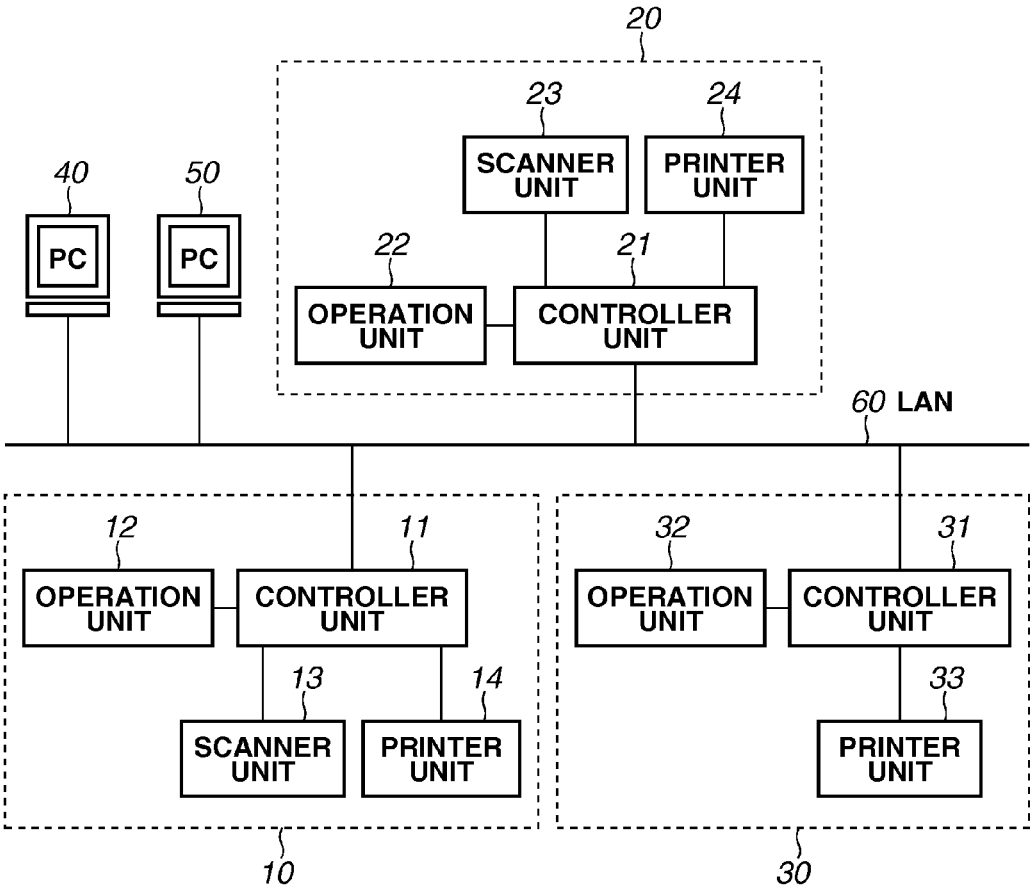
FIG. 1 is a block diagram illustrating a configuration of a system including an image forming apparatus.

FIG. 1 is a block diagram illustrating a configuration of a system that includes an image forming apparatus according to a first exemplary embodiment. The example illustrated in FIG. 1 is a system in which host computers 40 and 50 and image forming apparatuses (10, 20, and 30) are connected to a local area network (LAN) 60. In the system according to the present exemplary embodiment, the number of connected devices may be different from the number of devices illustrated in the FIG. 1. Further, although according to the present exemplary embodiment a LAN is employed as the connection method, some other connection method may also be employed. For example, any network, such as a wide-area network (WAN) (public line), may also be employed. The image forming apparatus according to the present exemplary embodiment is described based on an example in which the image forming apparatus is capable of executing power supply control for operating in a first power saving state and a second power saving state that consumes less power than the first power saving state. The first power saving state corresponds to a standby state in which images can be formed. The second power saving state corresponds to any of the power states illustrated in the below-described FIG. 6.

In FIG. 1, the host computers (hereinafter referred to as a personal computer (PC)) 40 and 50 have the functions of a personal computer. The PCs 40 and 50 can send and receive files and E-mail using a file transfer protocol (FTP) or server message block (SMB) protocol via the LAN 60 or a WAN. Further, the PCs 40 and 50 can issue a print command to the image forming apparatuses 10, 20, and 30 via a printer driver. In addition, the PCs 40 and can also periodically issue an inquiry to the image forming apparatuses 10, 20, and 30 about the state of the image forming apparatuses 10, 20, and 30. Based on the request from the PCs 40 and 50, the image forming apparatuses 10, 20, and 30 can send back information about whether printing is possible.

The image forming apparatus 10 and the image forming apparatus 20 have the same configuration. The image forming apparatus 30 is an image forming apparatus that only has a print function, and does not have the scanner unit 13 or 23 that the image forming apparatuses 10 and 20 have. For simplicity, between the image forming apparatuses 10 and 20, the following description will focus on the image forming apparatus 10 for a detailed description of the configuration.

The image forming apparatus 10 includes a scanner unit 13, which is an image input device, a printer unit 14, which is an image output device, a controller unit 11, which controls entire operations of the image forming apparatus 10, and an operation unit 12, which is a user interface (UI). Similarly, the image forming apparatus 20 includes a scanner unit 23, a printer unit 24, a controller unit 21, and an operation unit 22; the image forming apparatus 30 includes a printer unit 33, a controller unit 31, and an operation unit 32.

Figure 2:
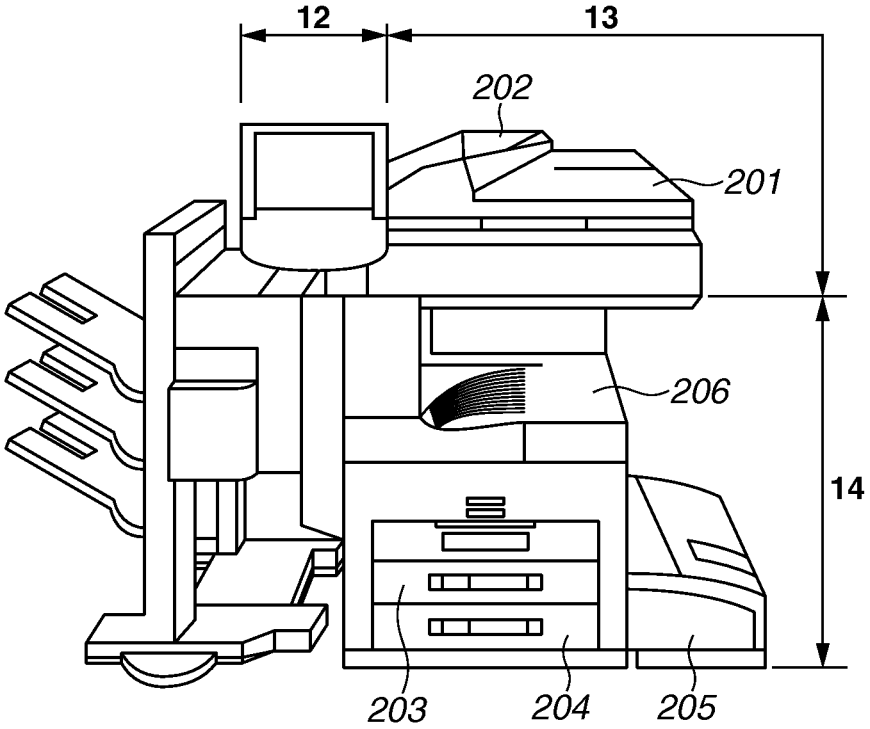
FIG. 2 is a perspective diagram illustrating an appearance of the image forming apparatus illustrated in FIG. 1.

FIG. 2 is a perspective diagram illustrating an appearance of the image forming apparatus 10 illustrated in FIG. 1.

In FIG. 2, the scanner unit 13 includes a plurality of charge-coupled devices (CCD). If sensitivity of each of the plurality of CCDs is different, even if density of each pixel on a document is the same, for example, each pixel will be recognized as having density different from each other. Therefore, the scanner unit 13 first exposes and scans a white plate (a uniformly white plate), converts the amount of reflected light obtained by the exposure and scanning into an electric signal, and outputs the electric signal to the controller unit 11. Next, the configuration for scanning the image on a document will be described.

The scanner unit 13 converts information about an image into an electric signal by inputting the reflected light obtained by the exposure and scanning of the image on the document into the CCDs. Further, the scanner unit 13 converts the electric signal into a luminance signal formed from red (R), green (G), and blue (B) colors, and outputs the luminance signal to the controller unit 11 as image data.

Documents are set in a tray 202 of a document feeder 201. When the user issues an instruction for starting document reading, a document reading instruction is transmitted from the controller unit 11 to the scanner unit 13. The scanner unit 13 receives this instruction, feeds the documents one by one from the tray 202 of the document feeder 201, and performs a document reading operation. The document reading method is not limited to an automatic feeding method performed by the document feeder 201. Alternatively, document reading may also be performed by placing a document on a glass platen (not illustrated), and scanning the document by moving the exposure unit.

The printer unit 14 is an image forming device that forms image data received from the controller unit 11 on a sheet. According to the present exemplary embodiment, an electrophotographic method that uses a photosensitive drum or a photosensitive belt is employed for the image forming method, but the image forming method is not limited thereto. Alternatively, an inkjet method in which ink is discharged from a micro-nozzle array to print on a sheet of paper may also be employed. Further, the printer unit 14 includes a plurality of paper cassettes 203, 204, and 205 that enable different paper sizes or different paper orientations to be selected. The printed paper sheets are discharged onto a discharge tray 206.

Figure 3:
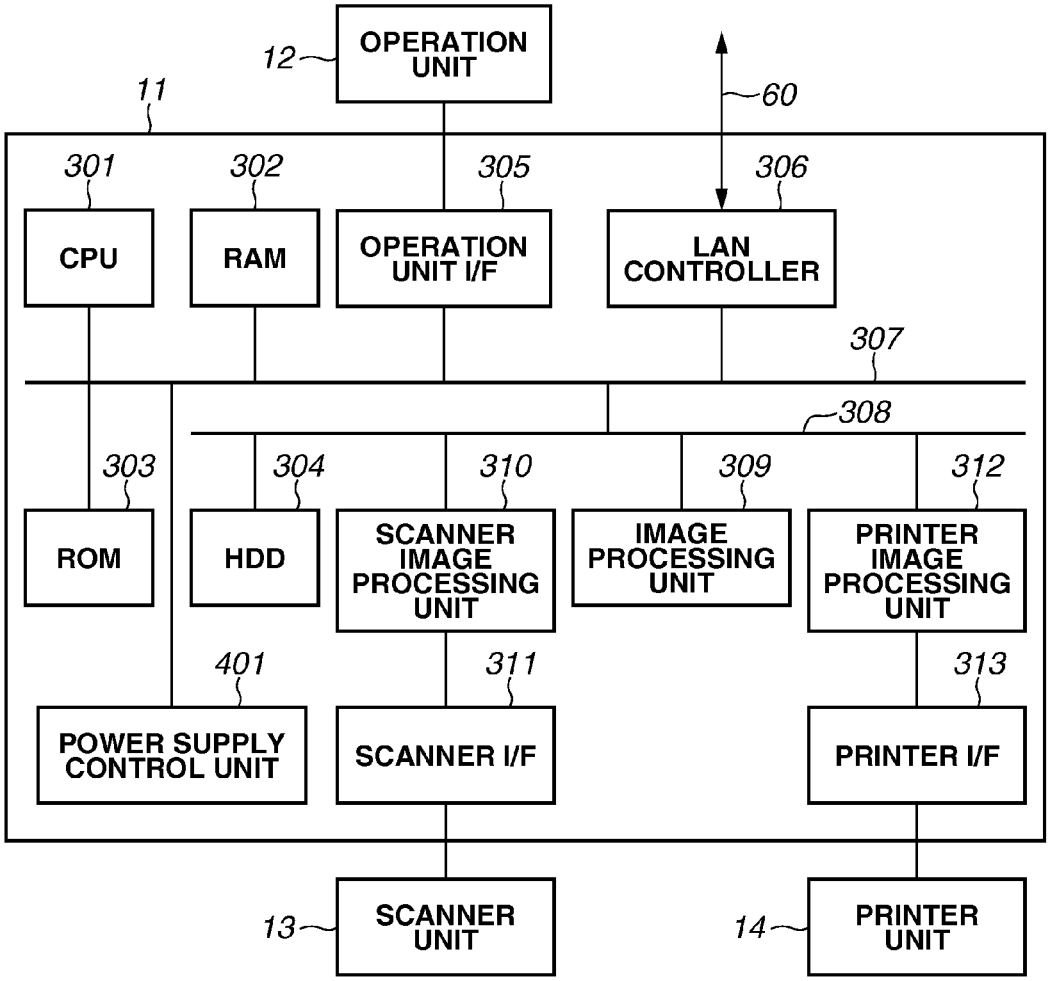
FIG. 3 is a block diagram illustrating a controller unit in an image forming apparatus.

FIG. 3 is a block diagram illustrating the controller unit 11 of the image forming apparatus 10 illustrated in FIG. 1. According to the exemplary embodiment, the controller unit 11 is electrically connected to the scanner unit 13 and the printer unit 14. The controller unit 11 is also connected via the LAN 60, for example, to the PCs 40 and 50 and to external devices. Consequently, the controller unit 11 is capable of inputting and outputting image data and device information.

In FIG. 3, a central processing unit (CPU) 301 performs overall control of access to each connected device based on a control program stored in a read-only memory (ROM) 303. The CPU 301 also performs overall control of various types of processing performed in the controller unit 11. A random-access memory (RAM) 302 is a system work memory on which the CPU 301 operates. The RAM 302 is also a memory for temporarily storing image data. The RAM 302 includes a static-RAM (SRAM), which holds stored content even after the power supply is turned off, and a dynamic-RAM (DRAM), in which stored content is deleted after the power supply is turned off. The ROM 303 stores a boot program for the image forming apparatus 10. A hard disk drive (HDD) 304 can store system software and image data.

An operation unit interface (I/F) 305 is for connecting a system bus 307 and the operation unit 12. This operation unit I/F 305 receives from the system bus 307 image data to be displayed on the operation unit 12, outputs the received image data to the operation unit 12, and outputs information input from the operation unit 12 to the system bus 307.

A LAN controller (network controller) 306, which is connected to the LAN 60 and the system bus 307, performs information input/output control. Further, the LAN controller 306, which also includes a power over Ethernet (POE®) power receiving unit, can be supplied with power from a LAN cable. Therefore, the LAN controller 306 can operate based on power supplied by POE®, and not just on power supplied from the power supply of the image forming apparatus 10.

An image bus 308, which is a transmission path for exchanging image data, includes a bus, such as a peripheral component interconnect (PCI) bus or an Institute of Electrical and Electronics Engineers (IEEE) 1394 bus. An image processing unit 309, which is for performing image processing, can read image data stored in the RAM 302, as well as perform image processing, such as enlargement or reduction of a Joint Photographic Experts Group (JPEG) image or a Joint Bi-level Image Experts Group (JBIG) image, and color adjustment.

A scanner image processing unit 310 corrects, processes, and edits image data received via a scanner I/F 311 from the scanner unit 13. The scanner image processing unit 310 determines whether the received image data is a color document or a monochrome document, and a text document or a photographic document. Further, the scanner image processing unit 310 attaches the determination result to the image data. The thus-attached information is referred to as attribute data.

A printer image processing unit 312 performs image processing on the image data while referring to the attribute data attached to the image data. The image-processed image data is output to the printer unit 14 via a printer I/F 313.

Figure 4:
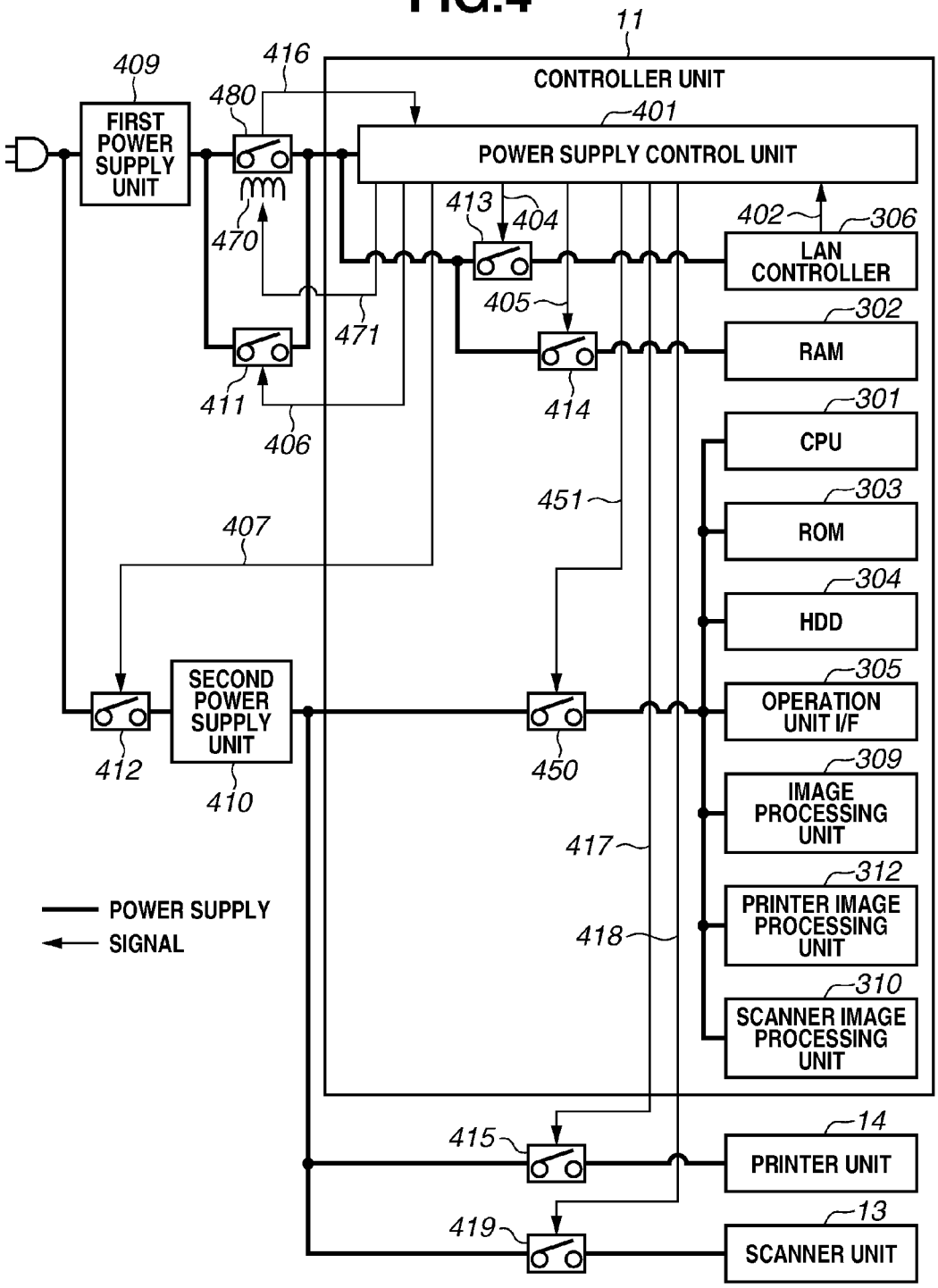
FIG. 4 is a block diagram illustrating a hardware configuration relating to power supply control.

FIG. 4 is a block diagram illustrating a hardware configuration relating to power supply control of the controller unit 11, the scanner unit 13, and the printer unit 14 illustrated in FIG. 1.

In FIG. 4, a power supply control unit 401 performs power supply control during startup and when turning off the power supply, and controls changes to the power supply state, such as shifting to or returning from a power saving state. The power supply control unit 401 is a unit that detects a return factor (e.g., reception of a facsimile (FAX), depression of a switch etc.) when returning from the power saving state. The power supply control unit 401 also performs power supply control when shifting to the standby state based on each return factor.

In addition, the power supply control unit 401 receives a command from the CPU 301 and a signal for detecting return from the power saving state, such as below-described wake signal 402, and based on the command, controls whether to supply power to each device from a first power supply unit 409 and a second power supply unit 410. Further, the power supply control unit 401 controls electrification of a solenoid 470 for turning off a power switch 480 when shutdown is executed from a remote environment. The solenoid 470 is used for switching the switch to the off side.

The wake signal 402 is a signal transmitted from the LAN controller 306 to notify the power supply control unit 401 that a packet addressed to the image forming apparatus 10 has been received by the LAN controller 306 via the network 60 while the LAN controller 306 was in a sleep state. If the power supply control unit 401 detects a wake signal 402, the power supply control unit 401 selects the power supply for supplying power to each device by controlling control signals 407, 417, 418, and 451. Control signals 404 to 407, 417, 418, and 451 are signals for controlling whether to supply power to each device.

Switches 411 to 414, 415, 419, and 450 are controlled by the control signals 404 to 407, 417, 418, and 451. By controlling the switches 411 to 414, 415, 419, and 450 with the control signals 404 to 407, 417, 418, and 451, the power supply state to each device can be changed. The switches 411 to 414, 415, 419, and 450 may be realized by a field-effect transistor (FET) or a relay switch, for example.

The control signal 404 and the switch 413 control the supply of power to the LAN controller 306. The control signal 404 and the switch 413 control in such a manner that when the image forming apparatus 10 is in the standby state or in the sleep state, power is supplied to the LAN controller 306, and when the image forming apparatus 10 is in an off state, the supply of power to the LAN controller 306 is stopped.

The control signal 405 and the switch 414 control a first power supply to the RAM 302. As an example, the control signal 405 and the switch 414 may control in such a manner that when the image forming apparatus 10 is in the sleep state, power is supplied from the first power supply to the RAM 302 being in a self-refresh state, and when the image forming apparatus 10 is turned off, the supply of power from the first power supply to the RAM 302 is stopped.

The control signal 406 and the switch 411 control the supply of the power from the first power supply unit 409 to the controller unit 11. The control signal 406 is turned on, and the switch 411 is then turned on, when the below-described power switch 480 is turned on by the user and a state notification signal 416 of the power switch 480 is received by the power supply control unit 401.

Consequently, power can be supplied to the controller unit 11 even when the user has turned off the power switch 480. The power supply control unit 401 in such a case detects that the power switch 480 has been turned off based on a state notification signal 416 of the power switch 480, and notifies the CPU 301 of the result. This enables the power supply to each device to be turned off after performing normal shutdown processing.

The power switch 480 is a switch operated by the user for turning the power supply to the image forming apparatus 10 on and off. When the user turns on the power switch 480, power is supplied from the first power supply unit 409 to the controller unit 11. The solenoid 470 is provided in the power switch 480. By energizing the solenoid 470, the power switch 480 switches to off. Consequently, when shutdown processing is received from a remote environment, the power switch 480 can be turned off by energizing the solenoid 470 by controlling a solenoid control signal 471.

The control signal 407 and the switch 412 control the supply of an alternating current (AC) to the second power supply unit 410. The second power supply unit 410 is a power supply that is turned off during the power saving state, and turned on during the standby state. For example, if the wake signal 402 is received by the power supply control unit 401 during the power saving state, the power supply control unit 401 turns on the switch 412 by controlling the control signal 407, so that the power supply to each of the devices that are required during the standby state can be turned on.

The first power supply unit 409 converts the AC power supply into a direct current (DC) power supply, and supplies the power supply control unit 401 and the like with a first power supply. The first power supply supplied from the first power supply unit 409 is a power supply provided in order to supply power to the power supply control unit 401 and the like even when the image forming apparatus 10 is in the power saving state. In addition to the power supply control unit 401, the first power supply is also supplied to the LAN controller 306 for detecting a packet addressed to the image forming apparatus 10 from the network 60 in order to return from the power saving state.

The second power supply unit 410 converts the AC power supply into a DC power supply, and supplies a second power supply to each device. The second power supply supplied from the second power supply unit 410 is a power supply that stops the supply of power when the image forming apparatus 10 is in a power saving state. The second power supply unit 410 is provided in order to supply power to each of the devices that do not need to be supplied with power during the power saving state.

Figure 5:
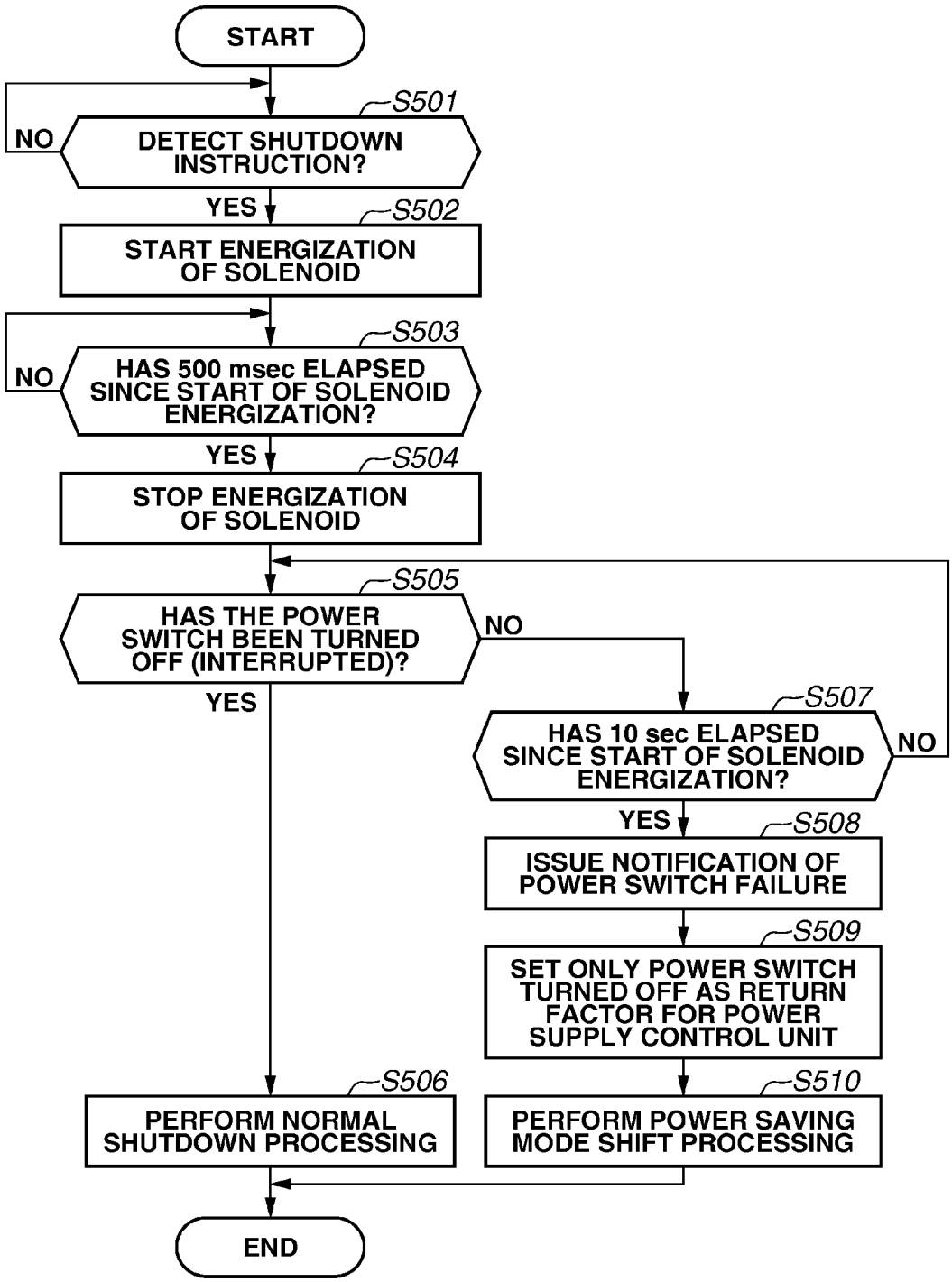
FIG. 5 is a flowchart illustrating control processing of an image forming apparatus.

FIG. 5 is a flowchart illustrating control processing of an image forming apparatus according to the present exemplary embodiment. The flowchart illustrated in FIG. 5 illustrates a control flow of the CPU 301 when a shutdown instruction has been issued from a remote environment or when auto-shutdown has occurred based on a timer. In this flowchart, each step is realized by the CPU 301 executing a control program stored in the ROM 303, for example. The power supply control that is executed when it is detected that the power supply to the image forming apparatus has not been cut after execution of a power-supply-off drive will be described in detail below.

In step S501, the CPU 301 detects whether a shutdown instruction has been issued from a remote environment or an auto-shutdown instruction has been issued based on a timer. If the CPU 301 detects a shutdown instruction (YES in step S501), the processing proceeds to step S502. A shutdown instruction is issued if a predetermined condition is satisfied.

In step S502, based on an instruction from the CPU 301, the power supply control unit 401 starts energizing the solenoid 470. If it is determined in step S501 that a shutdown instruction has been received, the CPU 301 issues an instruction to the power supply control unit 401 to control the solenoid control signal 471. By energizing the solenoid 470, the power switch 480, which includes the solenoid 470, is driven to be turned off.

In step S503, the CPU 301 determines whether 500 ms has elapsed since energization of the solenoid 470 started. The time period of 500 ms depends on the specification of the solenoid 470, and is described as an example. The duration for energizing the solenoid 470 may be set in a range that is capable of turning off the power switch 480, and that does not influence the life or qualities of the solenoid 470. Further, the determination of whether 500 ms has elapsed may be performed either based on a timer included in the CPU 301 or a hard timer included in the power supply control unit 401. If it is determined that that 500 ms has elapsed (YES in step S503), the processing proceeds to step S504.

In step S504, based on the instruction from the CPU 301, the power supply control unit 401 stops the energization of the solenoid 470. If it is determined by the CPU 301 in step S503 that 500 ms has elapsed, the CPU 301 issues the instruction to the power supply control unit 401 to control the solenoid control signal 471 so that energization of the solenoid 470 is stopped. Although it is described, according to the exemplary embodiment, that control is performed based on a determination of the elapsed time by the CPU 301, the power supply control unit 401 may also control the solenoid control signal 471 based on the hard timer included in the power supply control unit 401, without involving the CPU 301.

In step S505, the CPU 301 determines whether the power switch 480 has been turned off (interrupted). Specifically, the CPU 301 determines whether an interruption by a state notification signal 416 of the power switch 480 that is input to the power supply control unit 401 has been received. If the CPU 301 detects a turn-off interruption of the power switch 480 (YES in step S505), the processing proceeds to step S506. If the CPU 301 does not detect the turn-off interruption of the power switch 480 (NO in step S505), the processing proceeds to step S507.

If the CPU 301 detects the turn-off interruption of the power switch 480 in step S505, in step S506, the CPU 301 executes the normal shutdown processing. In this shutdown processing, the CPU 301 issues an instruction to the power supply control unit 401 to turn off the power supply, which ultimately enables the power supply to each device in the image forming apparatus to be turned off.

When the power supply control unit 401 receives shutdown processing from the CPU 301, the power supply control unit 401 turns off the power supply to each device by turning off the switches 411 to 414, 415, 419, and 450 through controlling the control signals 404 to 407, 417, 418, and 451.

In step S507, the CPU 301 determines whether 10 sec has elapsed since energization of the solenoid started. This time period of 10 sec is an example, and any other time periods may be applied as long as there is guarantee that it is a time period in which the power switch 480 can be driven to be turned off after energization of the solenoid 470. If it is determined that for some reason the power switch 480 cannot be turned off, and that the CPU 301 cannot detect the turn-off interruption of the power switch 480 even after 10 sec has elapsed (YES in step S507), the processing proceeds to step S508.

In step S508, the CPU 301 notifies the user that the power switch 480 could not be turned off. If the turn-off interruption of the power switch 480 cannot be detected by the CPU 301, the CPU 301 notifies the user that failure in either the power switch 480 or the solenoid 470 occurs. A notification unit can issue the notification by displaying a message on the operation unit 12 included in the image forming apparatus 10, or by sending via the LAN controller 306 an E-mail message to the administrator of the image forming apparatus 10 who is at the remote environment.

In step S509, the CPU 301 sets the power supply control unit 401 so that the image forming apparatus 10 returns from the power saving state when the power switch 480 is turned off. The setting for the power supply control unit 401 is performed so that the image forming apparatus 10 returns from the power saving state when the power switch 480 is turned off, and the image forming apparatus 10 is in a safe state even if the power switch 480 could not be turned off. Examples of the states in the power saving state include a high speed start state and a sleep state. FIG. 6 illustrates the power supply return factors for each power saving state. As illustrated in FIG. 6, after turning off of the power supply by a switch has been set as a return factor, the image forming apparatus 10 can be controlled so as not to return from the power saving state based on an ordinary return factor associated with the second power state.

In a case where the power switch 480 cannot be turned off, and if the image forming apparatus 10 is shifted to the power saving state while being in the same state as the high speed start state, the power switch 480 remains on. Therefore, as shown by the return factors illustrated in FIG. 6, the image forming apparatus 10 quickly returns from the power saving state even if the image forming apparatus 10 is shifted to the power saving state.

For example, the administrator believes that the power supply of the image forming apparatus 10 has been turned off and if a power stoppage operation for building maintenance is performed, a failure due to erroneous writing in the HDD 304 or the ROM 303, or an operation in which normal shutdown is not performed may occur by the power outage while the CPU 301 is operating.

Further, in a case where the power switch 480 cannot be turned off, and if the image forming apparatus 10 is shifted to the power saving state while being in the same state as the sleep state, the image forming apparatus 10 may be returned from the power saving state in response to arrival of a FAX or reception of a job, which are return factors illustrated in FIG. 6, even though the administrator believes that the power supply of the image forming apparatus 10 has been turned off from a remote environment. Consequently, the image forming apparatus 10 is in a state where the user does not intend (although the user intends to turn off the image forming apparatus 10, the image forming apparatus 10 is in an on state).

To avoid such a situation, the image forming apparatus 10 is set in such a manner that in a case where the power switch 480 cannot be turned off, turning off of the power switch 480 is set as a return factor that causes the image forming apparatus 10 to return from the power saving state. This allows the image forming apparatus 10 to avoid returning by various jobs, which is a return factor from the power saving state in the sleep state, without returning from the power saving state by turn-on detection of the power switch 480, which is a return factor from the power saving state in the high speed start state.

In step 5510, the CPU 301 executes a shift to a power saving state. Based on an instruction from the CPU 301, the power supply control unit 401 can turn off energization of components consuming a lot of current, such as a fixing device, by controlling the control signals 407, 417, 418, and 451 so that the switches 412, 415, 419, and 450 are turned off. Consequently, the power supply state of the whole image forming apparatus can be shifted from the first power state to the second power state.

FIG. 7 is a diagram illustrating an example of a UI screen displayed on the operation unit 12 illustrated in FIG. 3. The example illustrated in FIG. 7 is a message screen displayed on the operation unit 12 under the control of the CPU 301 in step S508 illustrated in FIG. 5.

According to the present exemplary embodiment, the user is notified by displaying of the message that the power switch 480 could not be automatically turned off, together with the message prompting the user to turn off the power switch 480 is also displayed.

FIG. 8 is a diagram illustrating an example of an E-mail message sent to an administrator under the control of the CPU 301 in step S508 illustrated in FIG. 5. The content of the sent message is the same as the message shown in FIG. 7. Based on the content to be notified, the message sent by E-mail may be sent to a plurality of notification destinations or sent to an individual notification destination. More specifically, the notification destination registered in the image forming apparatus 10 is not limited to the administrator, and the message may be sent to a plurality of users.

According to the exemplary embodiment, even when for some reason there has been a failure in the drive of a mechanical relay by a drive signal, the image forming apparatus 10 can be in a state where the image forming apparatus can avoid breakdowns in regard to a sudden power outage.

In a second exemplary embodiment, a control example in which the power switch 480 is turned off more reliably will be described.

Figure 9:
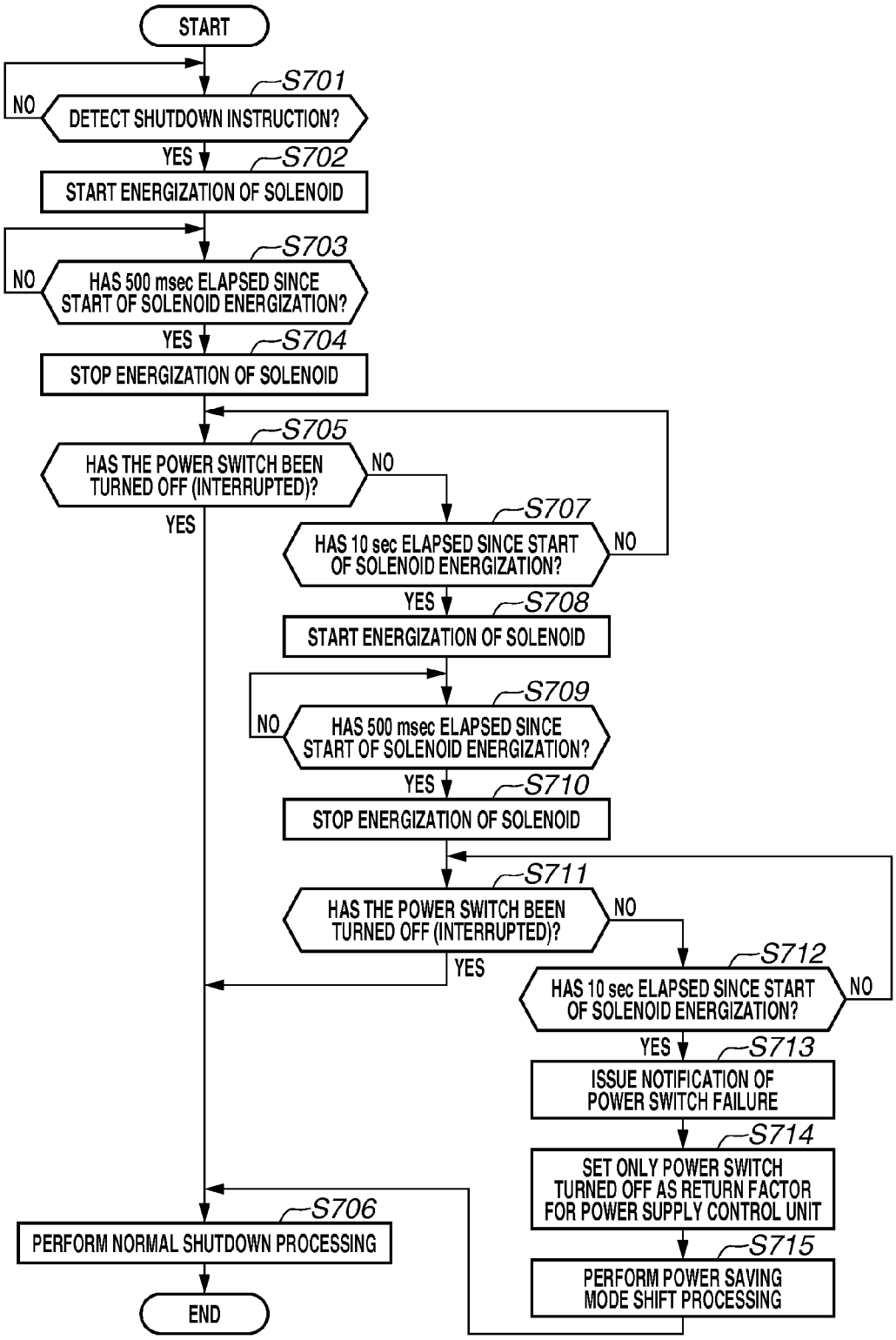
FIG. 9 is a flowchart illustrating control processing of an image forming apparatus.

FIG. 9 is a flowchart illustrating control processing of an image forming apparatus according to the present exemplary embodiment. In the present exemplary embodiment, a control flow in a case where a shutdown instruction has been issued from a remote environment or when auto-shutdown has occurred based on a timer will be described. In this flowchart, each step is realized by the CPU 301 executing a control program stored in the ROM 303, for example. Further, the processing of steps S701 to S707 is the same as the processing of steps S501 to 507 of the flowchart illustrated in FIG. 5, and thus a description thereof will be omitted here.

Steps S708 to S710 are the same as steps S502 to 504 of the flowchart illustrated in FIG. 5. After 10 sec has elapsed since energization of the solenoid 470 started in step S707, in step S708, based on an instruction from the CPU 301, the power supply control unit 401 starts energization of the solenoid 470. Then, in step S709, when the CPU 301 determines that 500 ms has elapsed, in step S710, the CPU 301 issues an instruction to the power supply control unit 401 to control the solenoid control signal 471, and the CPU 301 executes processing for again turning off the power switch 480. Consequently, if the power switch 480 could not be turned off due to some external factor during the initial energization of the solenoid 470, there is an increased likelihood that the power switch 480 can be normally driven to be turned off by the processing for turning off the power switch 480 that is performed at the second time.

The processing of steps S711 to S715 is the same as the processing of steps S505 to S510 of the flowchart illustrated in FIG. 5, and thus a description thereof will be omitted here.

Consequently, even if by accident the power switch 480 cannot be turned off, the likelihood that the power switch 480 can be turned off increases, so that the likelihood that normal shutdown can be executed increases.

In addition, the present invention can also be applied in a system configured from a plurality of devices (e.g., a computer, an interface device, a reader, a printer, and the like), or applied in an apparatus configured from a single device (a multifunction peripheral, a printer, a facsimile apparatus, or the like).

Each processing in the present invention can also be realized by a processing apparatus (a CPU, a processor) in a personal computer (computer) and the like executing software (a program) acquired via a network or various storage media.

According to the present invention, an image forming apparatus can be returned to a normal state even if a power outage occurred in a state in which the power supply had not been cut based on a remote instruction.

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-247118 filed Nov. 29, 2013, which is hereby incorporated by reference herein in its entirety.

What is claimed is:

1. An apparatus configured to operate in a first power state and in a second power state that consumes less power than the first power state, the apparatus comprising:

a power supply unit configured to supply power to each unit of the apparatus;

a switch configured to switch between an on position and an off position;

a drive unit configured to drive the switch to the off position from the on position;

an execution unit configured to control the drive unit to drive the switch to the off position from the on position, if a predetermined condition is satisfied when the apparatus is in the first power state; and a control unit configured to shift a power state of the apparatus from the first power state to the second power state in a case where the drive unit controlled by the execution unit fails to drive the switch to the off position from the on position.

2. The apparatus according to claim 1, wherein the second power state is a state in which power is not supplied to a printer unit and a scanner unit.

3. The apparatus according to claim 1, wherein the control unit is configured to set, before shifting from the first power state to the second power state, cutting of a power supply by the switch as a power supply return factor.

4. The apparatus according to claim 1, wherein the control unit is configured to control in such a manner that after setting cutting of a power supply by the switch as a power supply return factor, the apparatus does not return from the second power state by a normal power supply return factor associated with the second power state.

5. The apparatus according to claim 1, wherein the control unit is configured to cause, in a case where a power supply to the apparatus is not cut after executing of a power-supply-off drive, the execution unit to perform the power-supply-off drive for switching the switch to the off position using the drive unit.

6. The apparatus according to claim 1, further comprising:

a notification unit configured to perform a notification that the switch fails to switch to the off position in a case where the drive unit controlled by the execution unit fails to drive the switch to the off position from the on position.

7. The apparatus according to claim 6, wherein the notification unit displays the notification that the switch fails to switch to the off position on an operation unit included in the apparatus.

8. The apparatus according to claim 6, wherein the notification unit sends E-mail in which the notification that the switch fails to switch to the off position is described, to a user.

9. A method for controlling an apparatus configured to operate in a first power state and in a second power state that consumes less power than the first power state, the method comprising:

controlling a drive unit to drive a switch to an off position from an on position, if a predetermined condition is satisfied when the apparatus is in the first power state;

shifting a power state of the apparatus from the first power state to the second power state in a case where the drive unit fails to drive the switch to the off position from the on position.

10. The method according to claim 9, wherein the second power state is a state in which power is not supplied to a printer unit and a scanner unit.

11. The method according to claim 9, further comprising setting, before shifting from the first power state to the second power state, cutting of a power supply by a switch as a power supply return factor.

12. The method according to claim 9, further comprising controlling in such a manner that after setting cutting of a power supply by the switch as a power supply return factor, to not returning from the second power state by a normal power supply return factor associated with the second power state.

13. The method according to claim 9, further comprising performing, in a case where a power supply to the apparatus is not cut after executing of a power-supply-off drive, the power-supply-off drive for switching the switch to the off position.

14. The method according to claim 9, further comprising:

performing a notification that the switch fails to switch to the off position in a case where the drive unit fails to drive the switch to the off position from the on position.

15. A non-transitory computer-readable storage medium storing a program that causes a computer to execute the method for controlling an image forming apparatus according to claim 9.

16. The non-transitory computer-readable storage medium storing the program according to claim 15, wherein the second power state is a state in which power is not supplied to a printer unit and a scanner unit.

17. The non-transitory computer-readable storage medium storing the program according to claim 15, the program further comprising setting, before shifting from the first power state to the second power state, cutting of a power supply by a switch as a power supply return factor.

18. The non-transitory computer-readable storage medium storing the program according to claim 15, the program further comprising controlling in such a manner that after setting cutting of a power supply by the switch as a power supply return factor, to not returning from the second power state by a normal power supply return factor associated with the second power state.

19. The non-transitory computer-readable storage medium storing the program according to claim 15, the program further comprising performing, in a case where a power supply to the apparatus is not cut after executing of a power-supply-off drive, the power-supply-off drive for switching the switch to the off position.

20. The non-transitory computer-readable storage medium storing the program according to claim 15, the program further comprising:

performing a notification that the switch fails to switch to the off position in a case where the drive unit fails to drive the switch to the off position from the on position.

* * * * *